US005329079A

United States Patent [19]

English et al.

[11] Patent Number: 5,329,079

[45] Date of Patent: Jul. 12, 1994

[54] COMPUTER KEYBOARD WITH IMPROVED CANTILEVER SWITCH DESIGN

[75] Inventors: Goerge P. English, Coeur d'Alene, Id.; Theodore D. Clark, Spokane, Wash.

[73] Assignee: Key Tronic Corporation, Spokane, Wash.

[21] Appl. No.: 17,466

[22] Filed: Feb. 12, 1993

Related U.S. Application Data

[63] Continuation-in-part of Ser. No. 931,691, Aug. 18, 1992.

[51] Int. Cl.[5] ..... H01H 13/70

[52] U.S. Cl. ..... 200/5 A; 200/343

[58] Field of Search ..... 200/5 A, 5 R, 512, 517, 200/343; 84/423 R, 433, 434, 423 B

[56] References Cited

U.S. PATENT DOCUMENTS

| | | | |
|---|---|---|---|
| 2,544,140 | 3/1951 | Dofsen et al. | 18/59 |
| 2,862,664 | 12/1958 | MacDonald | 235/145 |
| 3,129,660 | 4/1964 | Miller | 101/103 |
| 3,353,647 | 11/1967 | Hugel | 197/18 |
| 3,721,926 | 3/1973 | Berenbaum et al. | 334/7 |
| 3,974,905 | 8/1976 | Johnson | 197/98 |
| 4,160,886 | 7/1979 | Wright et al. | 200/5 |
| 4,440,515 | 4/1984 | Nassimbene | 400/479 |
| 4,486,637 | 12/1984 | Chu | 200/340 |
| 4,560,844 | 12/1985 | Takamura et al. | 200/5 |
| 4,582,967 | 4/1986 | Brumit et al. | 200/5 A |
| 4,755,072 | 7/1988 | Hoornweg | 400/490 |
| 4,914,999 | 4/1990 | Masubuchi et al. | 84/423 R |
| 5,003,140 | 3/1991 | Abell, Jr. et al. | 200/344 |

FOREIGN PATENT DOCUMENTS

| | | | |
|---|---|---|---|
| 1188389 | 6/1982 | Canada | 340/187 |
| 0313952 | 10/1988 | European Pat. Off. | 13/70 |
| 2309041 | 3/1973 | Netherlands | 216/30 |
| 2084801 | 4/1982 | United Kingdom | 3/2 |

OTHER PUBLICATIONS

Dials et al., "Low Cost Keyboard Actuator", IBM Technical Disclosure Bulletin, vol. 25, No. 6, Nov. 1982 p. 2773.

Seibold, H. K.; "Sandwich Keyboard", IBM Technical Disclosure Bulletin, vol. 23, No. 9, Feb. 1981 p. 4177.

Kightlinger, D. A.; "Injection Mold Design For Keyboard", IBM Technical Disclosure Bulletin, vol. 25, No. 11B, Apr. 1983 p. 6222.

Anglin, et al.; "Unitary Plastic Keylever System", IBM Technical Disclosure Bulletin, vol. 10, No. 12, May, 1968 p. 1844.

Krauss et al., "Elektronische Flachtastatur", radio fernsehen elektronik, Berlin 34 (1985) 6 pp. 389–390.

*Primary Examiner*—Jeffrey A. Gaffin
*Assistant Examiner*—Michael A. Friedhofer
*Attorney, Agent, or Firm*—Wells, St. John, Roberts, Gregory & Matkin

[57] ABSTRACT

A computer keyboard has multiple rows of cantilevered keys which are flexibly attached to common mounting strips. The rows of cantilevered keys are arranged to partially overlap adjacent rows such that the keys in one row actuate switch contacts aligned beneath mounting strips in the adjacent row. Each cantilevered key has an elongated member extending between a common mounting strip and a key cap, whereby the elongated members are wider at the point of attachment to the common mounting strips than at a point adjacent to the key cap.

13 Claims, 13 Drawing Sheets

COMPUTER KEYBOARD WITH IMPROVED CANTILEVER SWITCH DESIGN

RELATED APPLICATIONS

This patent resulted from a continuation-in-part application from U.S. patent application Ser. No. 07/931,691.

TECHNICAL FIELD

This invention relates to computer keyboards, and more particularly to computer keyboards with cantilevered keys.

BACKGROUND OF THE INVENTION

As the computer keyboard industry matures, there is an increasing drive among keyboard manufacturers to produce lower cost keyboards. Traditionally, manufacturers have produced a keyboard 10 such as that shown in FIG. 1. One such prior art computer keyboard is disclosed in U.S. Pat. No. 4,560,844 granted to Takamura on Dec. 24, 1985.

Keyboard 10 includes multiple keys 12 mounted in a housing 14, which includes a rigid metal backing plate 16, a rigid metal or plastic mounting plate 18, and a rigid plastic enclosure 20. Keyboard 10 also has a switch membrane 22 and a dome sheet 24 positioned between backing plate 16 and mounting plate 18.

Mounting plate 18 has multiple key supports 26 into which key stems 30 of keys 12 are slidably mounted so that keys 12 can be moved from rest positions to activated positions.

Switch membrane 22 comprises multiple switch contacts positioned beneath respective keys 12. The switch contacts are actuated upon depression of these keys. Dome sheet 24 comprises multiple resilient domes 28 which project upward to bias keys 12 to their rest position. Domes 28 collapse when keys 12 are depressed and rebound to their original form when keys 12 are released by the user to provide the "spring-like" feel of the computer keys. When the keys are depressed, switch membrane 22 conveys an electric signal from the actuated switch contact to an electrical circuit, such as a microprocessor, which is also provided on keyboard 10, but not shown in this figure.

One of the drawbacks of the prior art keyboard shown in FIG. 1 concerns the bearing interface between monoblock key support 26 and key stem 30 of keys 12. At this interface, key stem 30 slides within key support 26, creating surface friction therebetween. As keyboards age, the surface friction increases and keys 12 begin to move less freely. As a result, keyboard users must press harder to depress the computer keys. The necessity of an increased pushing force contributes to user fatigue and other repetitive stress conditions. As the bearing interface further degrades, computer keys often "stick" in the depressed position or return very slowly to the rest position. In such situations, the friction between the key stem 30 and key support 26 is equal to, or greater than, the spring-like force provided by domes 28.

Keyboard manufacturers often lubricate the bearing interface between the key stem and support in an effort to lessen the problems caused by surface friction. Unfortunately, adding such lubricant requires additional assembly time and the use of special lubricants. This contributes to the overall cost of the computer keyboard.

Another drawback of the prior art keyboard shown in FIG. 1 is that individual keys must be separately and independently mounted in their corresponding key supports. Conventional keyboards typically consist of 101 keys. Individually assembling each key requires a significant amount of time and expense.

This invention provides a computer keyboard which eliminates the conventional key stem/support interface and reduces assembly time and expense by decreasing parts count, thereby removing the problems associated therewith.

BRIEF DESCRIPTION OF THE DRAWINGS

One or more preferred embodiments is described with reference to the following accompanying drawings.

FIGS. 4A and 4B are an exploded cross-sectional view of the FIG. 3 keyboard.

FIG. 14 is a diagrammatic cross-sectional view similar to the view taken along line 3—3 in FIG. 2, but illustrating a second preferred embodiment of this invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
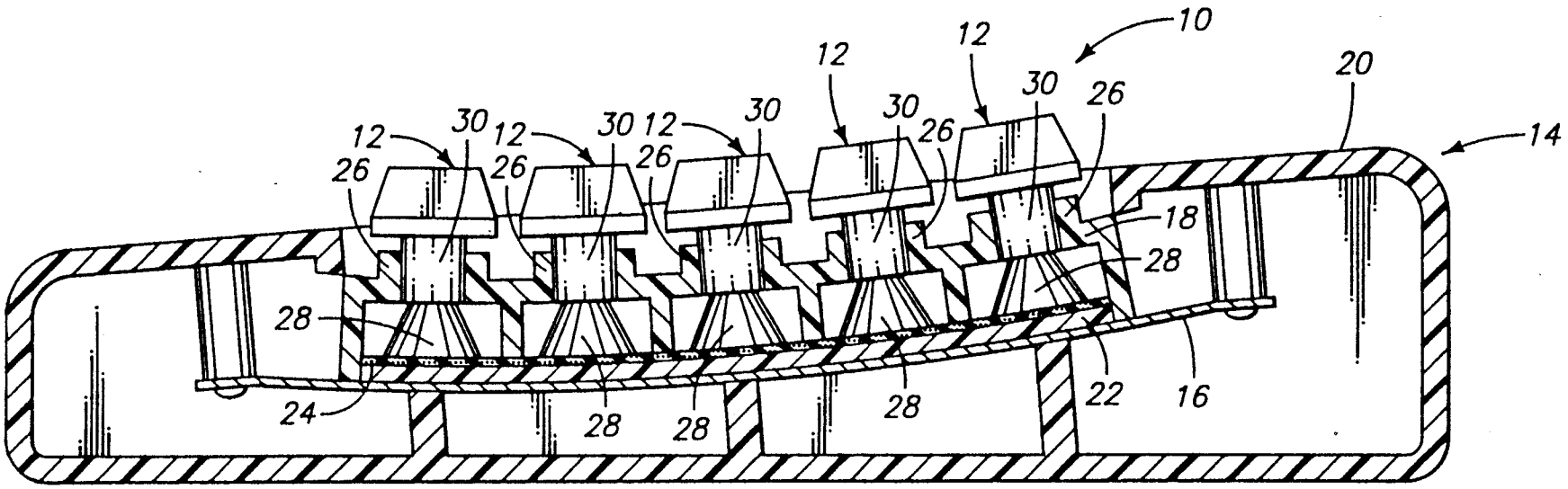
FIG. 1 PRIOR ART
FIG. 1 is a cross-sectional view of a prior art computer keyboard having keys movably mounted within a conventional monoblock structure.
Figure 2:
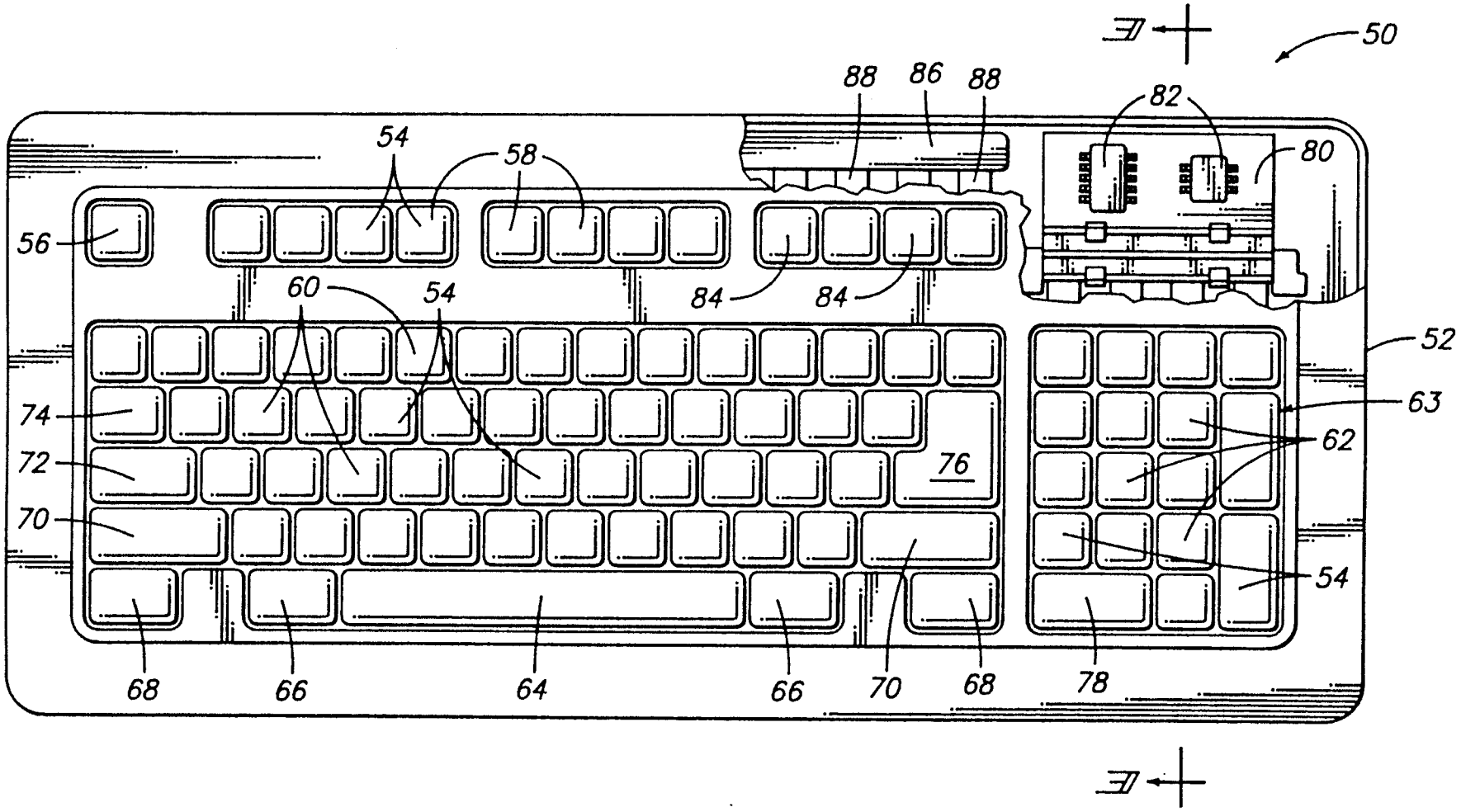
FIG. 2 is a diagrammatic top plan view of a computer keyboard according to this invention with a partial cut away through the upper right hand portion of the computer keyboard enclosure to expose a switch membrane/PCB interface.

FIG. 2 diagrammatically shows a computer keyboard 50 constructed in accordance to this invention. Keyboard 50 comprises a rigid, plastic housing or enclosure 52 and multiple keys 54 arranged within housing 52 in a selected configuration. Keys 54 include an "escape" key 56 and "function" keys 58 arranged across the top of the keyboard, "QWERTY" keys 60 which define the standard typewriter arrangement, and "numeric" keys 62 of the adder pad 63 at the right of the keyboard.

Most of the computer keys in keyboard 50 are "single-wide" keys such as "escape" key 56 and "function" keys 58. Some keys are "multi-wide" keys such as "spacebar" key 64, "alt" keys 66, "control" keys 68, "shift" keys 70, "cap lock" key 72, "tab" key 74, "enter" key 76, and "insert" key 78. The "single-wide" keys have narrow key caps with a width less than that of the key caps of "multi-wide" keys.

The key layout of keyboard 50 is provided for illustration purposes. Most computer keyboards constructed today have more keys than are shown in keyboard 50. For example, computer keyboards typically have 101 keys which include, in addition to those identified above, "cursor" keys and "edit" keys interposed between the "QWERTY" keys 54 and the "numeric" keys 62. This invention is not limited to the illustrated keyboard, but may be incorporated into a keyboard having any number of keys (including both "single-wide" and "multi-wide" keys) and arranged in any selected configuration.

The upper right-hand portion of computer keyboard 50 is illustrated with a portion of enclosure 52 cut away to illustrate the underlying circuitry and interface construction. Computer keyboard 50 includes a mother board or printed circuit board (PCB) 80 having multiple integrated circuits 82 and other electronic components mounted thereon. Typically, the integrated circuits consist of one or more microprocessors. Other electronic components mounted on PCB 80 include resisters, capacitors, diodes, and frequency reference. Indicator lamps (not shown) for identifying certain operational modes (such as "num lock", "caps lock", and "scroll lock") may also be mounted on PCB 80.

PCB 80 is designed to fit within the upper right hand corner of computer keyboard 50 above adder pad 63 and to the right of the "function" keys 58. The positioning of PCB 80 is facilitated by a new PCB/membrane interface constructed according to this invention which is described below in more detail.

According to an aspect of this invention, individual rows of keys 54 in keyboard 50 are integrally formed with a common base unit or mounting strip. As shown in FIG. 2, the right most function keys (referenced with numeral 84) are integrally constructed with mounting strip 86. Individual keys 84 are mounted to strip 86 by elongated members 88 such that keys 84 are cantilevered about mounting strip 86. This integral construction is illustrated more clearly in FIG. 5, and is discussed below in greater detail.

Figure 3:
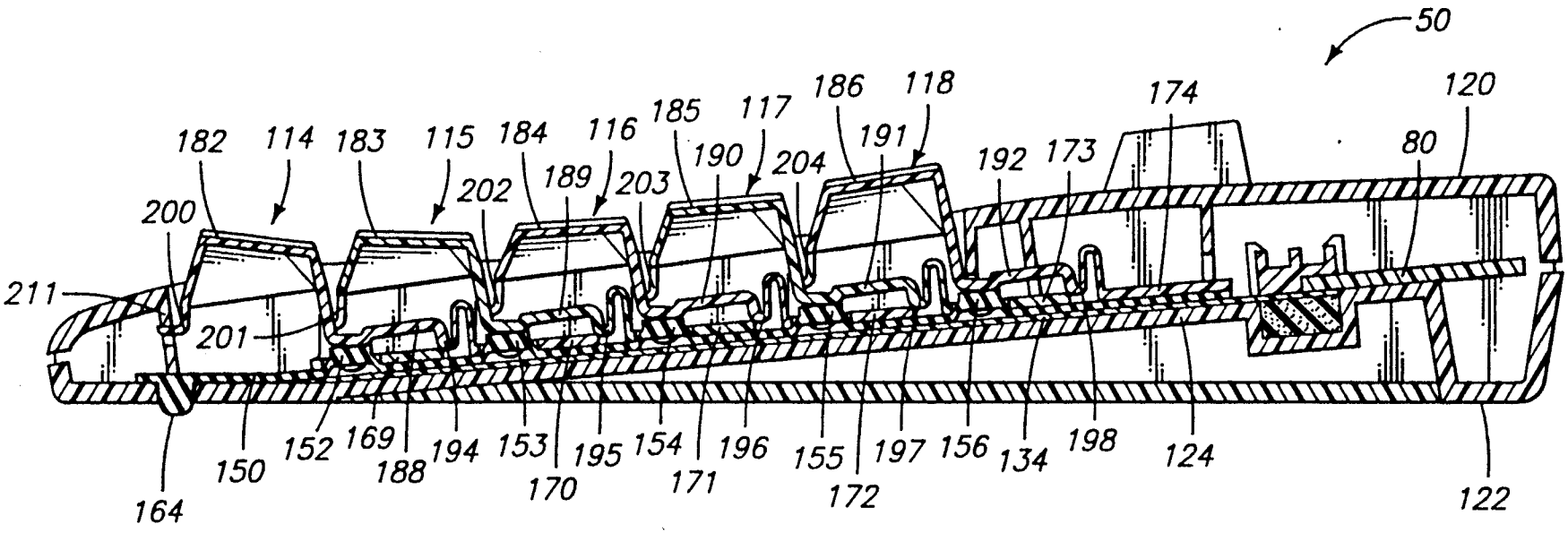
FIG. 3 is a diagrammatic cross-sectional view taken along line 3—3 in FIG. 2 illustrating a first preferred embodiment of this invention.

FIGS. 3 and 4A–4B diagrammatically illustrate a cross-sectional view of computer keyboard 50 taken through the adder pad 63 (along line 3—3 in FIG. 2). Computer keyboard 50 includes a top enclosure portion 120 and a lower enclosure portion 122 and multiple cantilevered keys 114–118. Top and bottom enclosure portions 120 and 122 are preferably formed of rigid plastic and molded in a suitable aesthetic appearance to provide an encasing for cantilevered keys 114–118. Bottom enclosure portion 122 includes an inclined support member or plate 124 having an upper surface 126. Support plate 124 has multiple clips 128–133 (FIG. 4B) projecting upward from upper surface 126. These clips are explained below in more detail.

Keyboard 50 has a switch membrane 134 disposed on top of upper surface 126 of bottom enclosure portion 122. Switch membrane 134 comprises an upper layer 136 and a lower layer 138 which are preferably formed of a flexible, insulative material such as Mylar. Switch membrane 134 includes multiple spacers 140 formed on upper and lower layers 136 and 138. Preferably, spacers 140 are made of non-conductive silk screen material deposited onto the layers in a selected pattern. Switch membrane 134 has multiple switch contacts **142*a*/142*b*–146*a*/146*b* arranged for actuation by respective keys 114–118**.

Upper contacts **142*a*–146*a* on upper layer 136 are aligned with, but spaced from, respective lower contacts 142*b*–146*b* on lower layer 138. Spacers 140 maintain an appropriate air gap separation between the switch contacts such that signals are not conducted through this air gap. The separation can be overcome, however, upon depression of associated keys 114–118**.

Switch membrane 134 includes multiple conductive traces formed thereon (not shown) which conduct electric signals from associated contact switches to terminals or pads located at peripheral edges 148. Preferably, switch contacts **142*a*/142*b*–146*a*/146*b*** and the conductive traces are formed of silver. Alternatively, the switch contacts can be formed of carbon-based materials.

Although switch membrane 134 is disclosed as two separate layers, it may comprise a single layer folded onto itself to form the upper and lower layers 136 and 138. Alternatively, the switch membrane may comprise a single layer with pairs of spaced switch contacts formed on an upper surface. The contacts are then actuated by conductive shunts molded or attached to a portion of the collapsible domes. Such switch constructions are shown, for example, in U.S. Pat. No. 4,677,268, U.S. Pat. No. 4,760,217, and U.S. Pat. No. 4,814,561. As yet another alternative, the switch membrane may comprise two layers of switch contacts separated by a third insulative layer having openings formed at the switch contact locations. This alternative embodiment eliminates the use of spacers 140.

Computer keyboard 50 further includes a dome sheet 150 disposed on top of switch membrane 134. Dome sheet 150 is formed of a resilient insulative material, such as rubber or an elastomeric material, and has multiple resilient and collapsible domes 152–156. Domes 152–156 are appropriately spaced on dome sheet 150 to align with corresponding switch contacts **142*a*/142*b*–146*a*/146*b***.

Individual domes comprise a cylindrical section 158 and a frustoconical section 160 which suspends cylindrical section 158 above dome sheet 150. Frustoconical section 160 is designed to collapse upon application of a downward force to cylindrical section 158. However, due to the resiliency of the dome sheet material, the domes "spring back" to their non-collapsed state once the downward force is removed. Each of the domes also includes an actuator knob 162 which protrudes downward from a bottom surface of the cylindrical section 158 in direct alignment with respective switch contacts of the switch membrane 134.

Dome sheet 150 also includes a raised portion 164 positioned at one peripheral end thereof. When assembled, the raised portion extends through an opening 166 formed in bottom enclosure portion 122. The raised portion 164 operates as a pad or platform peg to support the front end of computer keyboard 50. This construction eliminates the use of separate rubber pegs which are typically mounted to the exterior of the enclosure after the keyboard has been assembled. This aspect of the invention reduces material costs and assembly time.

Computer keyboard 50 comprises multiple mounting strips 170–174 to which respective cantilevered keys 114–118 are flexibly attached. An additional strip 169 is positioned adjacent to mounting strip 170, but no key is attached to this strip. Strips 169–174 are positioned on top of dome sheet 150 and secured to support plate 124 via respective clips 128–133. Preferably, dome sheet 150 and switch membrane 134 have aligned apertures (not shown) formed therein through which respective clips 128–133 extend to clamp onto corresponding mounting strips 170–174.

In an alternative embodiment, clips 128–133 may be formed as part of mounting strips 169–174 which extend downwardly through the aligned apertures in dome sheet 150 and switch membrane 134 to clip into support plate 124. Either embodiment constitutes a clip means for securing the mounting strips to the support plate. Additionally, apart from clips 128–133, other known fastening members, such as screws, snaps, ultrasonic welding, heat staking and glued extensions, may be employed as an effective clip means.

Mounting strips 169–173 include respective apertures 176–180 formed therein to receive corresponding domes 152–156. Mounting strip 174 does not have any such openings because there is no corresponding dome.

Cantilevered keys 114–118 comprise respective key caps 182–186 and elongated members 188–192. Elongated members 188–192 have one end flexibly attached to corresponding mounting strips 170–174 and the other end coupled to associated key caps 182–186. Key caps 182–186 are supported by elongated members 188–192 in a cantilevered fashion. Elongated members 188–192 are preferably attached to corresponding mounting strips 170–174 by serpentine-shaped hinges 194–198.

Figure 6:
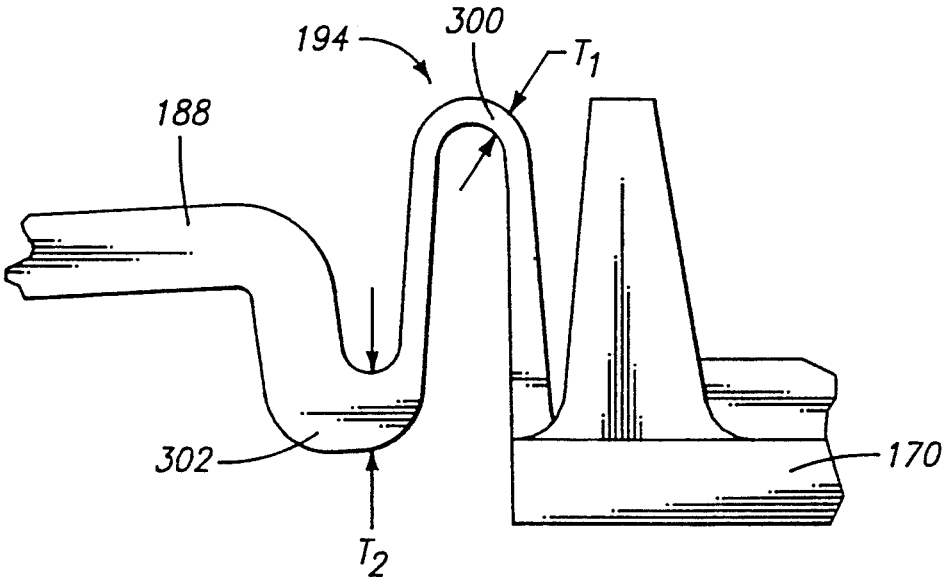
FIG. 6 is an enlarged sectional view of a flexible hinge used to attach cantilevered keys to mounting strips.

FIG. 6 shows an enlarged view of a representative, serpentine-shaped hinge 194 which couples elongated member 188 of first cantilevered switch 182 to mounting strip 170. Hinge 194 is preferably "S"-shaped having a first bend 300 connected to mounting strip 170 and a second bend 302 connected to elongated member 188. The "S"-shaped hinge helps reduce wear and fatigue of the hinge (which is preferably plastic) used to support the cantilevered keys. First bend 300 has a cross-sectional thickness $T_1$ which is less than a cross-sectional thickness $T_2$ of second bend 302. The thicknesses are selectable during design to identify a desired cantilevered point about which the cantilevered keys rotate. According to these thickness profiles, the cantilevered point occurs in first bend 300. While the "S"-shaped hinge is preferable, a single-bend or other multi-bend hinges can be employed according to this invention.

Returning to FIGS. 3 and 4A–4B, lower layer 138 of switch membrane 134 extends slightly beyond upper layer 136. PCB 80 is aligned adjacent to the end of upper layer 136 and on top of the end of lower layer 138. This arrangement provides the switch membrane/PCB interface 218 which is another aspect of this invention. This interface is described in more detail with reference to FIGS. 15 and 17.

Figure 5:
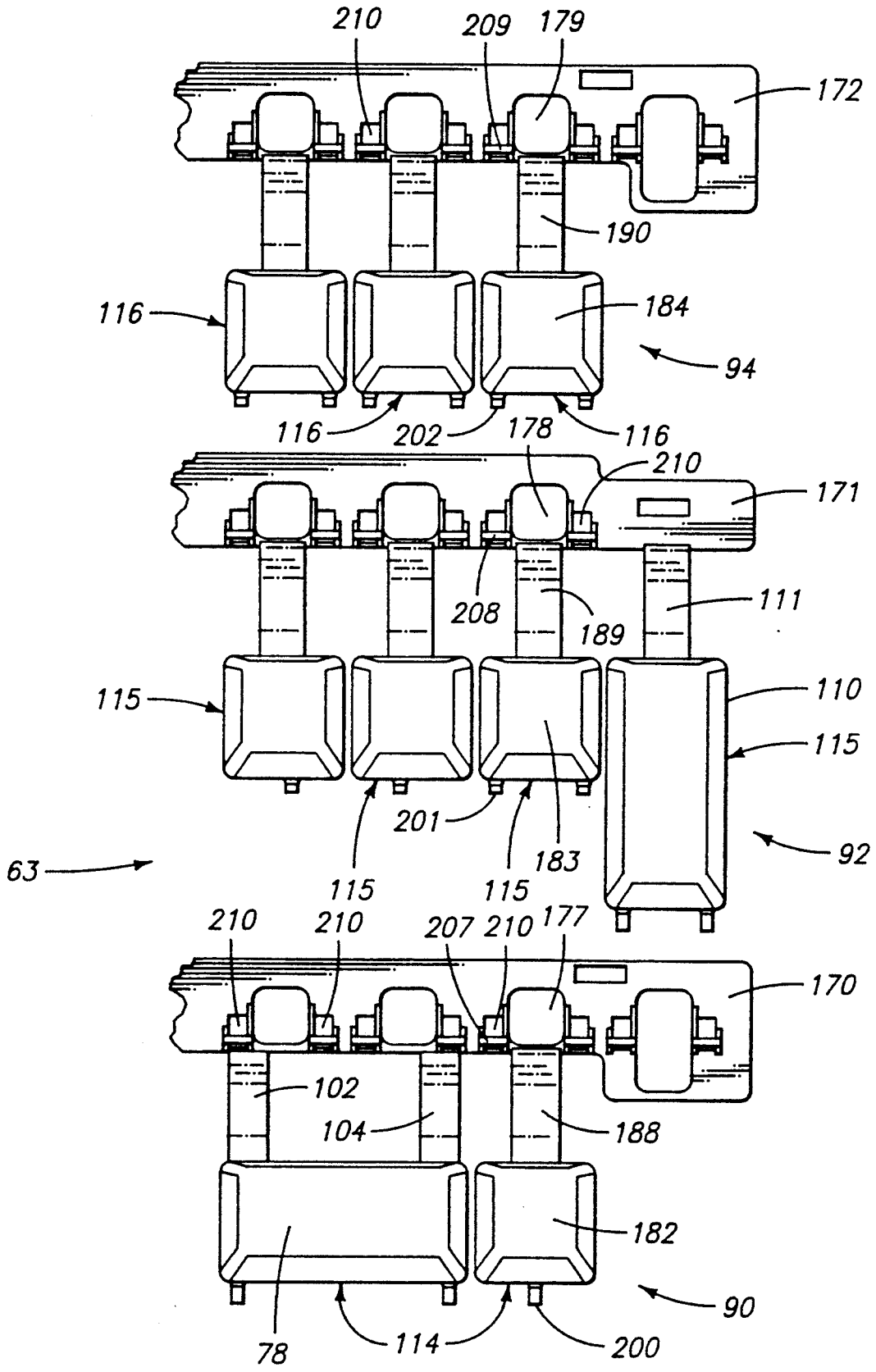
FIG. 5 is a diagrammatic, exploded top plan view of "numeric" keys positioned in an adder pad portion of the keyboard illustrating a first preferred embodiment of this invention.

FIG. 5 illustrates an exploded view of a portion of the adder pad 63 having rows of cantilevered keys. With reference to FIGS. 3–5 and for purposes of continuing discussion, cantilevered keys 114, 115, and 116 will be referred to respectively as "first", "second", and "third" cantilevered keys which are aligned in respective "first" row 90, "second" row 92, and "third" row 94. Mounting strips 170, 171, and 172 will be referred to respectively as "first", "second", and "third" mounting strips. Each of the first cantilevered keys 114 in the first row 90 are operatively attached to first mounting strip 170. Similarly, each of the second and third cantilevered keys 115, 116 in respective second and third rows 92, 94 are operatively attached to a common corresponding second and third mounting strip 171, 172.

First row 90 of first cantilevered keys 114 and first mounting strip 170 are preferably formed of a single, integral unit of plastic (FIG. 5). Similarly, the second and third rows of cantilevered keys are each formed of a single, integral unit of plastic. Alternatively, the key caps can be molded in a separate process and then mounted to the elongated member. Such a process is desirable where the key cap is to be shaded a different color than the other keys of the keyboard. For example, adder pad "enter key" 110 may be colored gray in a separate process and then attached to elongated member 111.

Alternatively, keytops can be molded in a multiple-color process wherein two or more colors are molded simultaneously. In such a process, each cantilevered key is gated individually, allowing different colored material (such as plastic) to be directed to desired keys. This results in different colored keys attached to the same integral keystrip. The different colored plastics blend within the mounting strip, which is hidden beneath the enclosure and thus, not visible to the keyboard user. This alternative process is efficient and cost effective.

Domes 152–156 of dome sheet 150 and switch contacts **142*a*/142*b*–146*a*/146*b* in switch membrane 134 are arranged in horizontal rows running longitudinally across the keyboard and are associated with the rows of corresponding cantilevered keys 114–118. The domes extend upwardly through corresponding rows of apertures in mounting strips 169–173**. The rows of switch contacts are aligned beneath corresponding rows of domes and mounting strip apertures.

Multi-wide "0/INS" key 78 (FIG. 5) has two elongated members 102 and 104 which connect its wider key cap to mounting strip 170. An aligned dome and switch contact are positioned beneath both elongated members 102 and 104. The switch contacts are preferably connected in parallel such that actuation of either contact (for example, by depressing only the right or left hand side of a multi-wide key) will effectuate the desired key stroke operation. This construction therefore does not employ leveling wires or the like to ensure the key is horizontally level during depression. Other multi-wide keys, such as the "spacebar" key, "control" key, "cap lock" key, etc., also employ multiple elongated members with corresponding domes and switches.

According to this invention, cantilevered keys 114–118 are configured in an overlapping arrangement. The second row 92 of second cantilevered keys 115 are positioned adjacent to, and partially overlapping, the first row 90 of first cantilevered keys 114. Likewise, the third row 94 of third cantilevered keys 116 are adjacent to, and partially overlapping, the second row 92 of second cantilevered keys 115.

In this configuration, elongated members 190 of third cantilevered key 116 extends above second mounting strip 171 and rests on top of dome 154. Key cap 184 of third cantilevered key 116 extends above a portion of elongated member 189 of second cantilevered key 115. As the third cantilevered key 116 is depressed to its activated position, dome 154 buckles or collapses so that actuating knob 162 forces upper switch contact **144*a* into actuating engagement with lower switch contact 144*b***.

Second cantilevered key 115 extends above first mounting strip 170 and the elongated portion of first cantilevered key 114 to rest on dome 153. Second cantilevered key 115 depresses dome 153 to actuate switch contacts **143*a*/143*b*. Likewise, first cantilevered key 114 engages and buckles dome 152 to actuate switch contacts 142*a*/142*b***.

According to another aspect of this invention, cantilevered keys 114–118 have one or more hooks 200–204 integrally formed with, and projecting downward from, corresponding key caps 182–186. Complementary and corresponding loops 206–209 are formed on associated mounting strips 169–172 adjacent to dome apertures 176–179 (FIG. 5). The hooks are slidably interconnected with corresponding loops. Second apertures (as represented with numeral 210 in FIG. 5) are provided beneath the loops and adjacent to the dome apertures. The purpose of these second apertures is discussed below.

Figure 7:
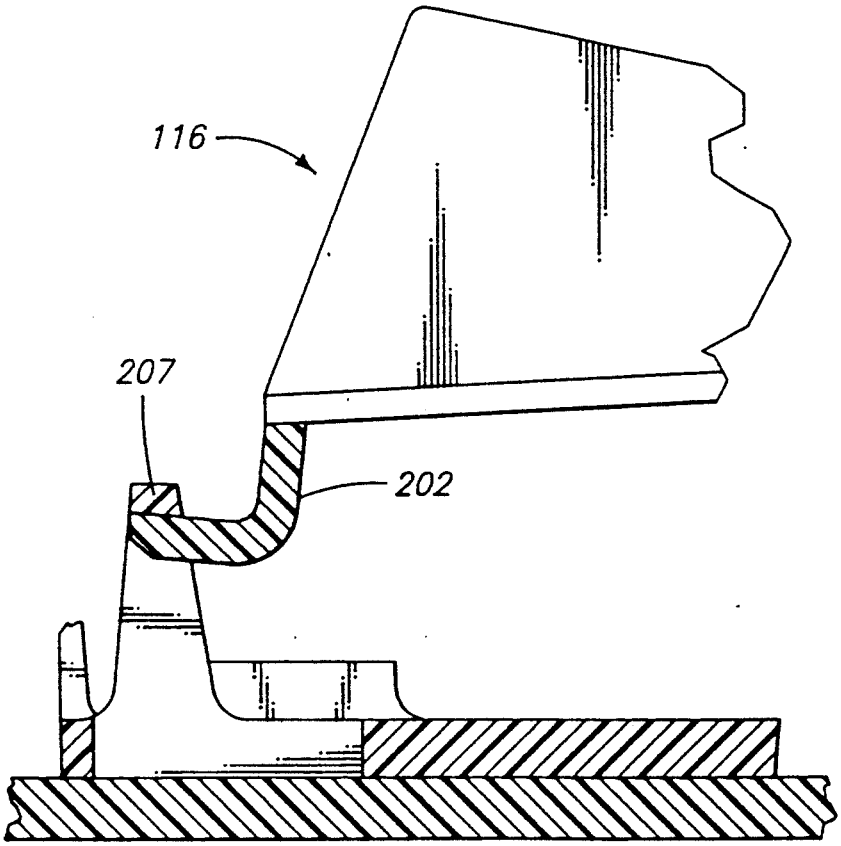
FIG. 7 is an enlarged cross-sectional view of a front section of a key in its rest position.
Figure 8:
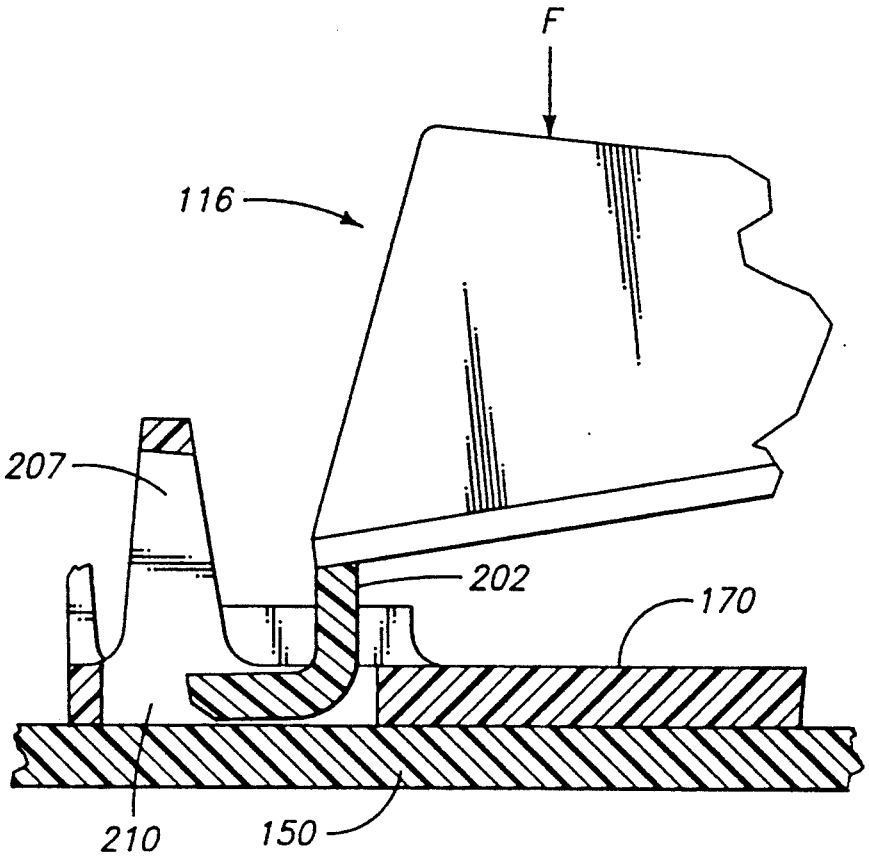
FIG. 8 is an enlarged cross-sectional view of the front section of the key in its depressed, activated position.

The loop and hook arrangement is shown more clearly in the enlarged, sectional views of third cantilevered key 116 shown in FIGS. 7 and 8. In FIG. 7, third cantilevered key 116 is in its rest position. Hook 202 abuts against loop 207 to limit the upward travel of third cantilevered key 116. Upon application of a downward force F (FIG. 8), hook 202 slides downward within loop 207 and through opening or aperture 210 formed in first mounting strip 170. Hook 202 "bottoms out" against rubber or elastomer dome sheet 150. This results in a very quiet keystroke. The present invention significantly reduces noise problems encountered by prior art keyboards which experience a plastic-against-plastic collision caused by plastic key bodies striking against plastic enclosures or mounting plates.

When the downward force F is removed, the cantilevered key returns upwardly towards its rest position under the influence of the resilient "spring-like" dome. Hook 202 once again abuts corresponding loop 207 to limit upward travel of the cantilevered keys. The hook and loop arrangement effectively prevents the cantilevered keys from "jumping" beyond the rest position under the spring induced force of the dome once the applied force F is removed.

With reference to FIG. 3, top enclosure portion 120 includes a lip 211 which operates as the "loop" for hook 200 to limit upward travel of first cantilevered key 182. In this manner, no additional mounting strip is employed. Mounting strip 169 provides loop 206 for hook 201 of second cantilevered key 115.

Although the present invention has been described as employing a hook and loop arrangement, other upstop means for establishing upward travel stop position of the cantilevered keys are possible. Preferably, the upstop means comprises complementary first and second interlocking components wherein one of the interlocking components is provided on a mounting strip and the other interlocking component is provided on the cantilevered key. One possible alternative is a cylindrical rod, with a ball formed on one end, projecting downward from a key cap and being slidably mounted within an interlocking ring-like component. The ball abuts against the ring-like component to limit upward travel of the key. Other mechanical arrangements are also possible.

To summarize the overlapping cantilevered structure of this invention, one row of cantilevered keys depresses domes and actuates switches in rows which are arranged beneath the mounting strip of the adjacent row of cantilevered keys. The upstop means for this one row of cantilevered keys is provided in part on the mounting strip of the next adjacent row of cantilevered keys (i.e., two rows over). For example, third cantilevered key 116 depresses dome 154 and actuates switch contacts **144*a*/144*b* which are aligned beneath second mounting strip 171. The upstop mechanism for the third row of cantilevered keys 116 is provided on the first mounting strip 170** of the first cantilevered keys which are two rows over.

This structure is advantageous in that it provides significant cantilevered action about the mounting strip due to the lengthy moment arm provided by the elongated members, and yet the keys are still closely packaged and arranged to provide a standard keyboard configuration to which the user is well familiar.

Figure 9:
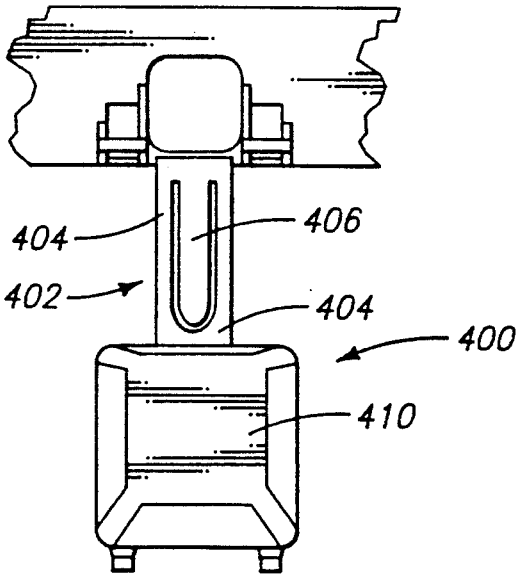
FIG. 9 is a diagrammatic top plan view of a cantilevered key according to one embodiment of this invention.
Figure 10:
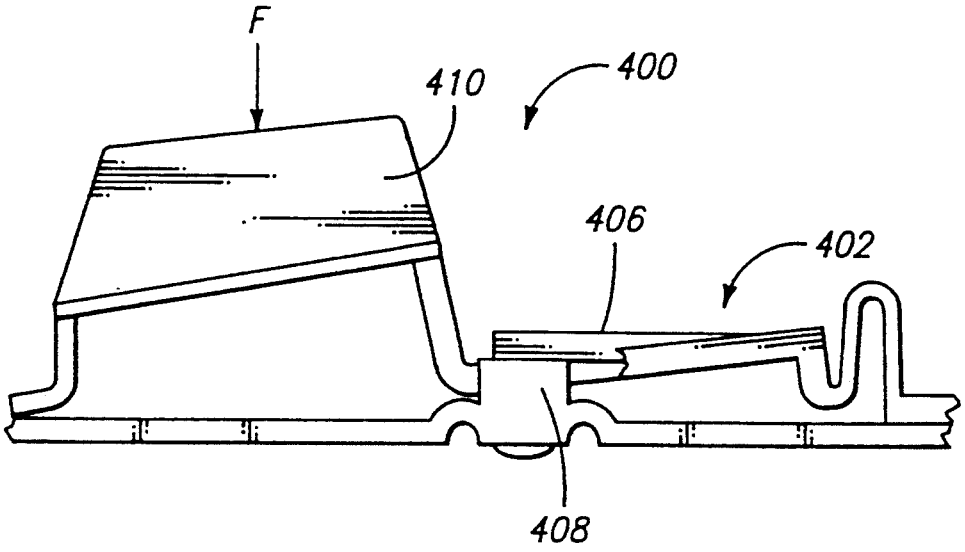
FIG. 10 is a diagrammatic side view of the FIG. 9 key illustrated in its depressed, activated position.
Figure 11:
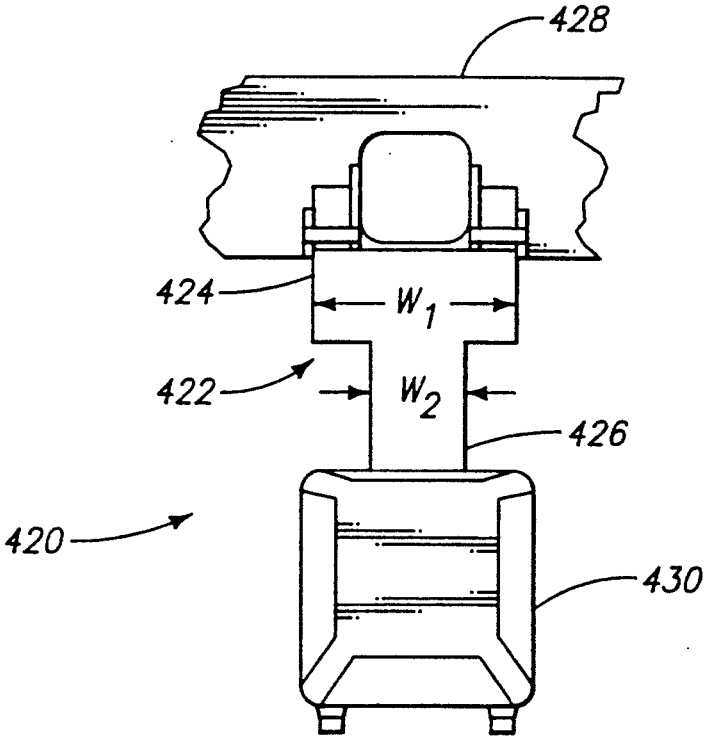

FIGS. 9 and 10 illustrate an alternative embodiment for a cantilevered key construction according to this invention. Cantilevered key 400 comprises an elongated member 402 having rigid beams 404 which support the cantilevered key 400 and a central, flexible, spring-like member 406. Flexible member 406 is a "U"-shaped cutout portion of elongated member 402 (FIG. 9). As shown in FIG. 10, flexible member 406 is positioned above and engages resilient dome 408. Upon application of a downward force F, cantilevered key 400 is moved to an intermediate position which causes dome 408 to buckle or collapse. As cantilevered key 400 is depressed beyond the intermediate position, flexible member 406 bends upward slightly to allow key cap 410 and rigid beams 404 to continue their downward movement. Flexible member 406 thereby provides an overtravel means for allowing depression of cantilevered key 400 after the collapse of dome 408.

Figure 11:
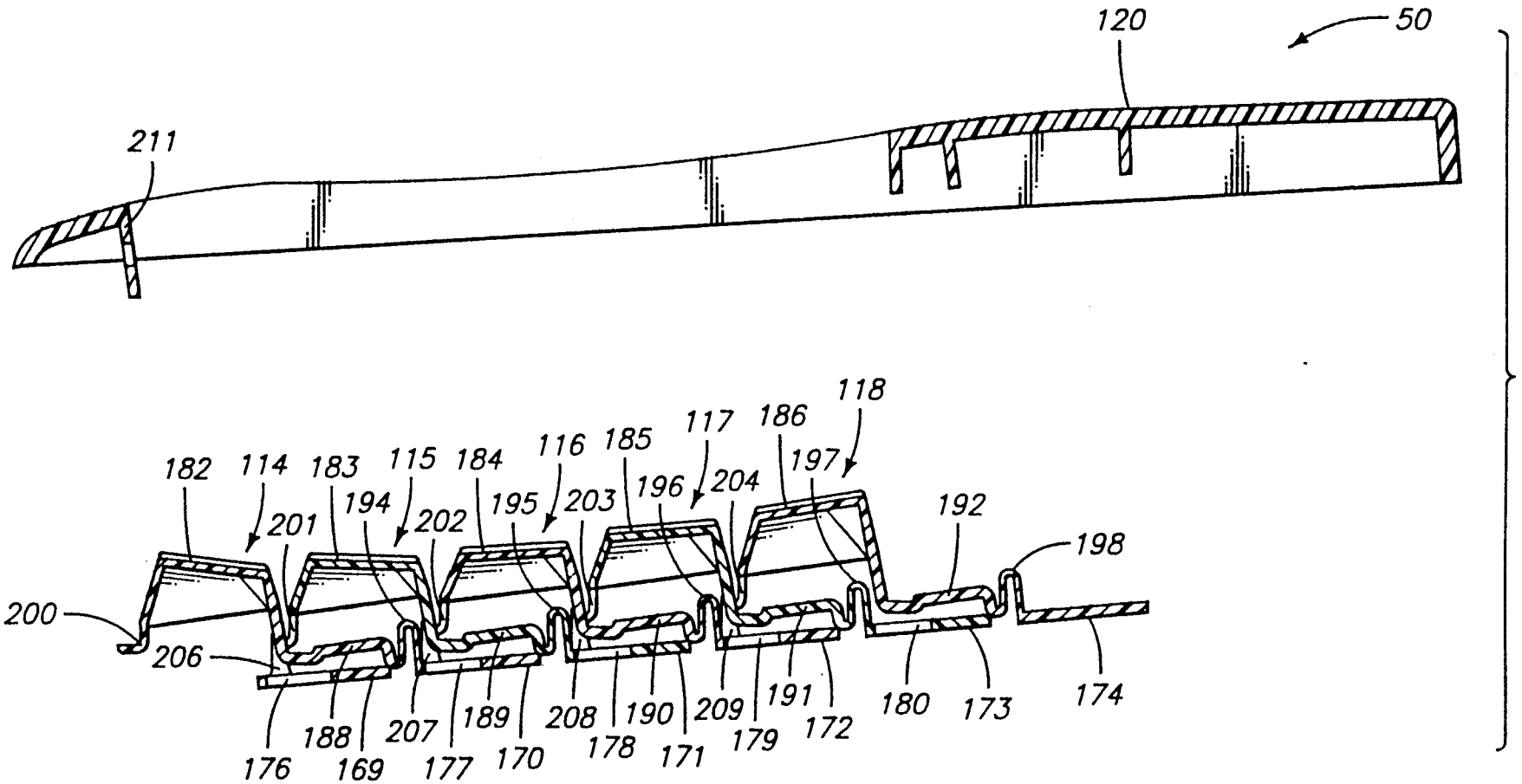
FIG. 11 is a diagrammatic top plan view of a cantilevered key according to another embodiment of this invention.
Figure 11:
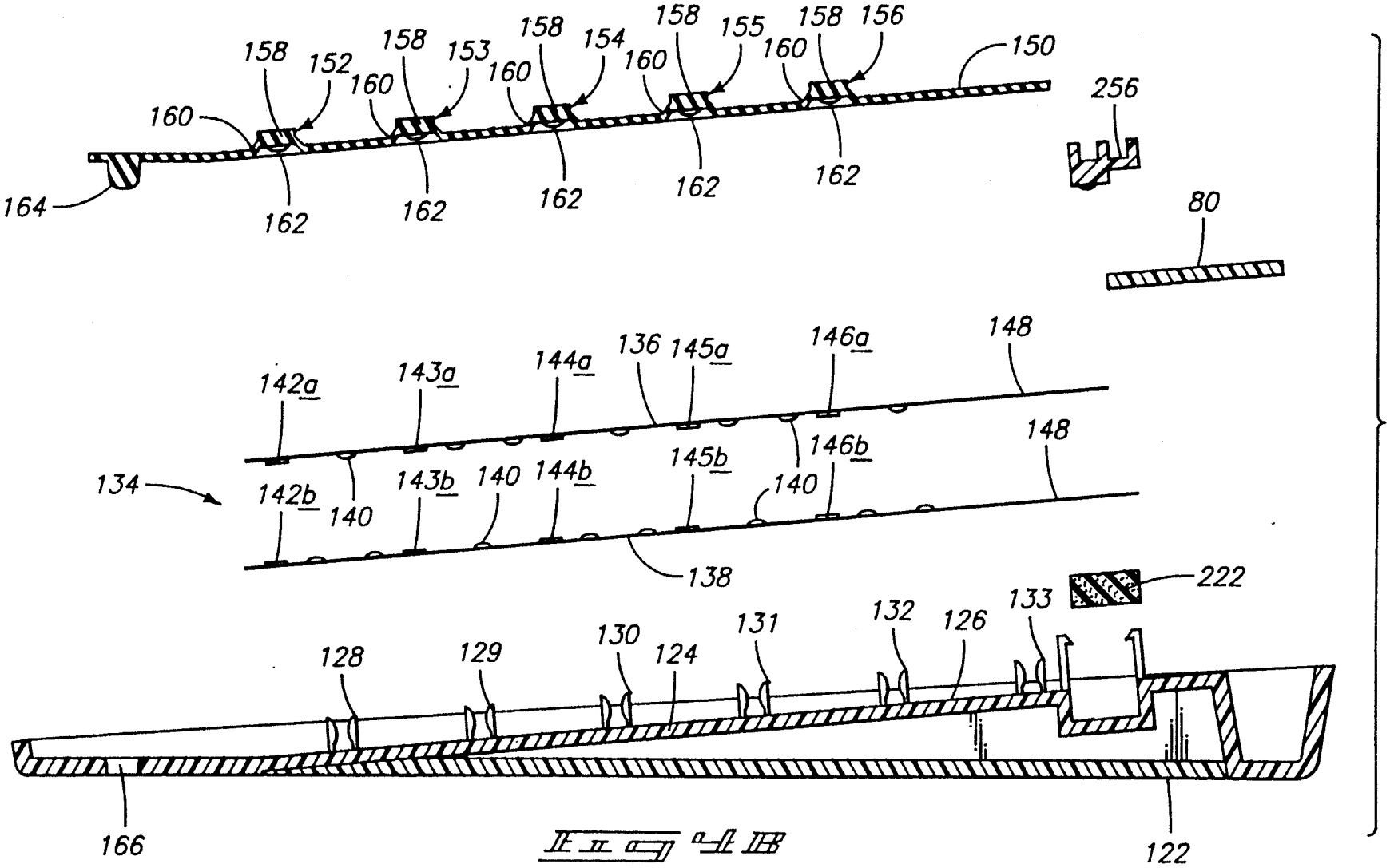

FIG. 11 illustrates another embodiment for a cantilevered computer key of improved stability and strength. This cantilevered key can be employed in keyboard 50 of this invention and only the key itself is discussed below in detail. Cantilevered key 420 comprises an elongated member 422 with one end flexibly attached to a mounting strip 428 and the other end coupled to a key cap 430. Elongated member 422 is preferably attached to mounting strip 428 via a serpentine-shaped hinge, or more preferably, an "S"-shaped hinge such as hinge 194 shown in FIG. 6.

Elongated member 422 has a rear portion 424 with an enlarged first width $W_1$ and a front portion 426 with a narrow second width $W_2$, whereby first width $W_1$ is greater than second width $W_2$. The wider rear portion 424 preferably encompasses the flexible attachment means, such as the serpentine-shaped hinge or the "S"-shaped hinge. Preferably, the ratio of first width $W_1$ to second width $W_2$ is at least approximately 2:1, with a ratio of approximately 3:1 being most preferred. The enlarged hinge portion improves stability and strength of the cantilevered computer key by preventing undesired longitudinal twisting of elongated member 422. The wider hinge portion confines movement of the cantilevered key to a stable, non-torsional pivoting about the edge of mounting strip 428.

Figure 12:
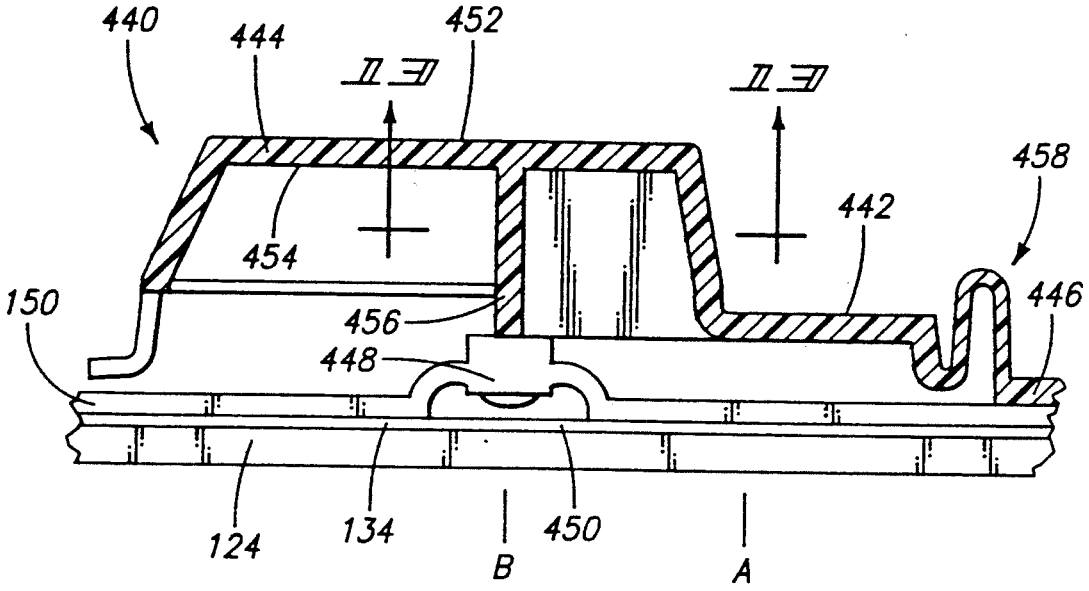
FIG. 12 is a diagrammatic cross-sectional view of a long, narrow cantilevered key having a "T"-shaped actuator.
Figure 13:
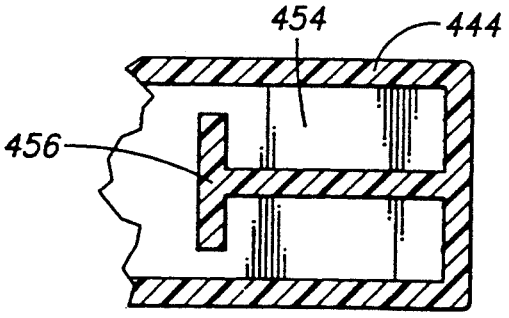
FIG. 13 is a cross-sectional view taken along lines 13—13 in FIG. 12 to illustrate the "T"-shaped actuator.
Figure 11A:
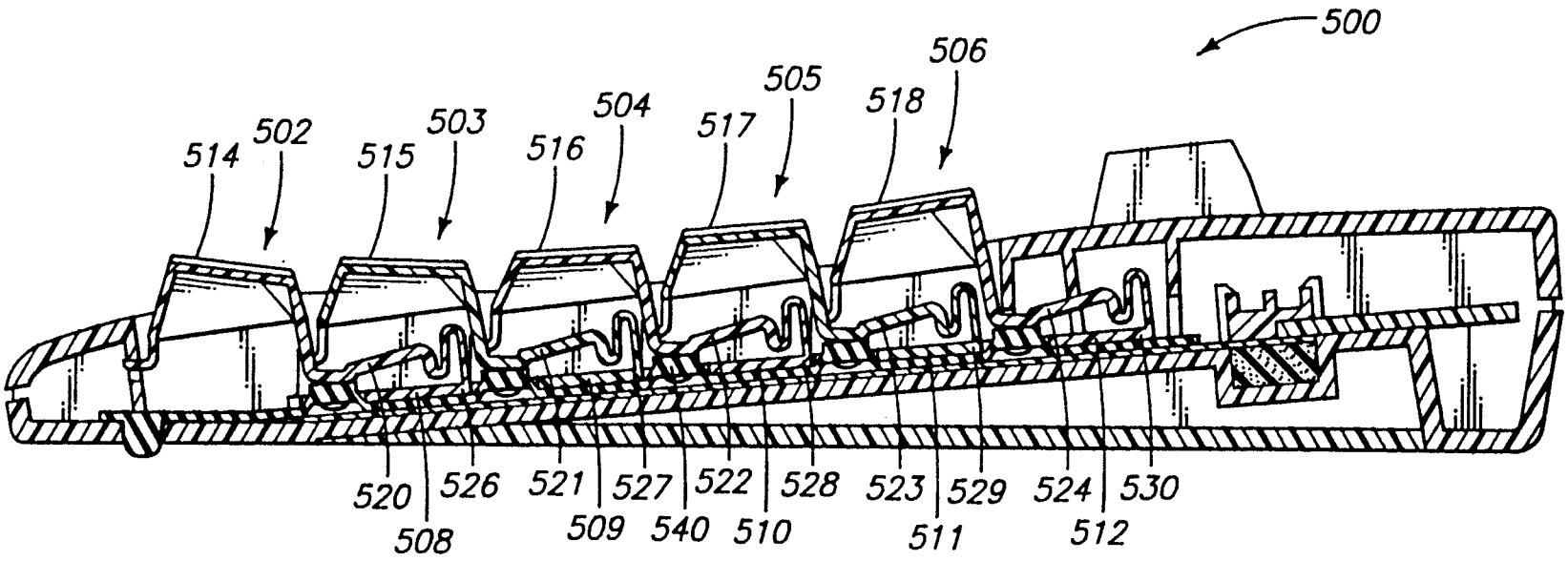

FIGS. 12 and 13 illustrate another aspect of this invention. In each of the computer keys of other embodiments, a portion of the elongated member is used to engage the dome and actuate the switch contact. For long narrow keys such as the adder pad "enter key" 110 (FIG. 5) and other "multi-height" keys, the point of contact by the user's finger can be significantly spaced from the point where the elongated member engages the dome to actuate the switch contact. This causes a different "feel" as compared to that of the single wide, single height keys, such as the QWERTY keys.

FIGS. 12 and 13 diagrammatically show an alternative embodiment suitable for a "multi-height" computer key 440 which can be employed in keyboard 50. Computer key 440 includes an elongated member 442 which interconnects a key cap 444 and a mounting strip 446. Computer key 440 is mounted above dome sheet 150, switch membrane 134, and support plate 124 such that key cap 444 is aligned above its corresponding resilient dome 448 and switch contact 450.

Computer key 440 has an actuator means for engaging and depressing dome 448 to actuate switch contact 450. The hollowed key cap 444 has a top surface 452 contoured for receiving an operator's finger and a bottom surface 454 which faces dome 448 and switch contact 450. The actuator means comprises a "T"-shaped member 456 which projects downward from bottom surface 454 to rest atop dome 448. In this manner, the point of engagement between computer key 440 and dome 448 is at location B which is more squarely positioned beneath the likely point of contact of the user's finger.

Computer key 440 thereby provides enhanced "feel" and control by moving the dome engagement point radially outward with respect to cantilevered point 458 from location A to location B. This allows the long keys to have the same "feel" as the single wide, single height keys.

It should be noted that the dome and switch contact are formed at location B and are therefore not in linear alignment with other domes and switch contacts positioned beneath other keys in the row. To accommodate this shift, the apertures formed in the mounting strip and arranged beneath a multi-height computer key are enlarged. This is shown, for example, in FIG. 5 wherein the right most aperture in the lower mounting strip 170 is enlarged.

FIG. 14 illustrates a computer keyboard 500 according to another aspect of this invention. Computer keyboard 500 differs from keyboard 50 in the way the cantilevered keys are mounted to the mounting strip; in this embodiment, the keys are mounted to the rear of the mounting strip and extend transversely across their own strip. This arrangement effectively reduces the keyboard width dimension by approximately the width of a mounting strip, allowing keyboard 500 to have more narrow width than keyboard 50. This arrangement reduces total parts count by eliminating the need for strip 169 of keyboard 50 illustrated in FIG. 3. Much of keyboard 500 contains components identical to those employed in keyboard 50 (such as the dome sheet, switch membrane, top and bottom enclosures, and PCB interface), and such are not discussed below with respect to this embodiment.

Keyboard 500 has multiple cantilevered keys 502–506 which are flexibly mounted to corresponding mounting strips 508–512. The mounting strips have respective back edges 526–530 and respective front edges. Cantilevered keys 502–506 comprise respective key caps 514–518 and elongated members 520–524. Elongated members 520–524 have one end flexibly attached to back edges 526–530 of corresponding mounting strips 508–512 and the other end coupled to associated key caps 514–518. The elongated members are preferably attached to the mounting strips by serpentine-shaped hinges, and most preferably, by "S"-shaped hinges.

According to this arrangement, the elongated member extends over its own common mounting strip. More specifically, the cantilevered key extends from the back edge of the mounting strip above and transversely across the mounting strip and beyond the front edge of the mounting strip to overlap a portion of the next forward cantilevered key. Unlike keyboard 50 of FIGS. 3 and 4A–4B, the domes extend up through the same mounting strip to which the associated actuating elongated member is attached. This arrangement conserves space. The mounting strips are still preferably formed with oval apertures to permit passage of corresponding domes. However, the strips can also be formed with "U"-shaped apertures which surround the associated domes on three sides, whereby the upstop loops are mounted on opposing sides and adjacent to the "U"-shaped slots.

To summarize this alternative keyboard construction, one row of cantilevered keys depresses domes and actuates switches in rows which are arranged beneath the mounting strip of the same row of cantilevered keys. The upstop means for this one row of cantilevered keys is provided in part on the mounting strip of the adjacent row of cantilevered keys (i.e., one row over). For example, second cantilevered key 504 depresses dome 540 and actuates the corresponding switch contacts which are aligned beneath second mounting strip 510. The upstop mechanism for the second cantilevered key 504 is provided on the first mounting strip 509 of the first cantilevered key 503 which is in the next adjacent row.

Figure 15:
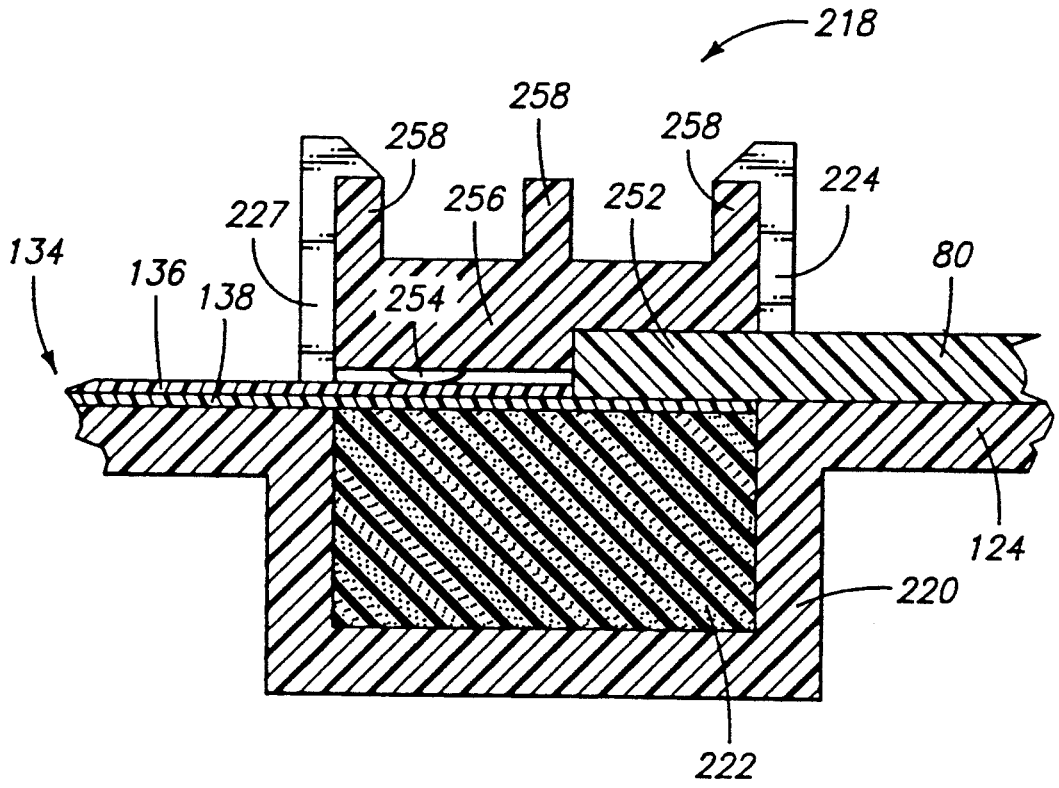
FIG. 15 is a cross-sectional view of a switch membrane/PCB interface according to this invention.
Figure 16:
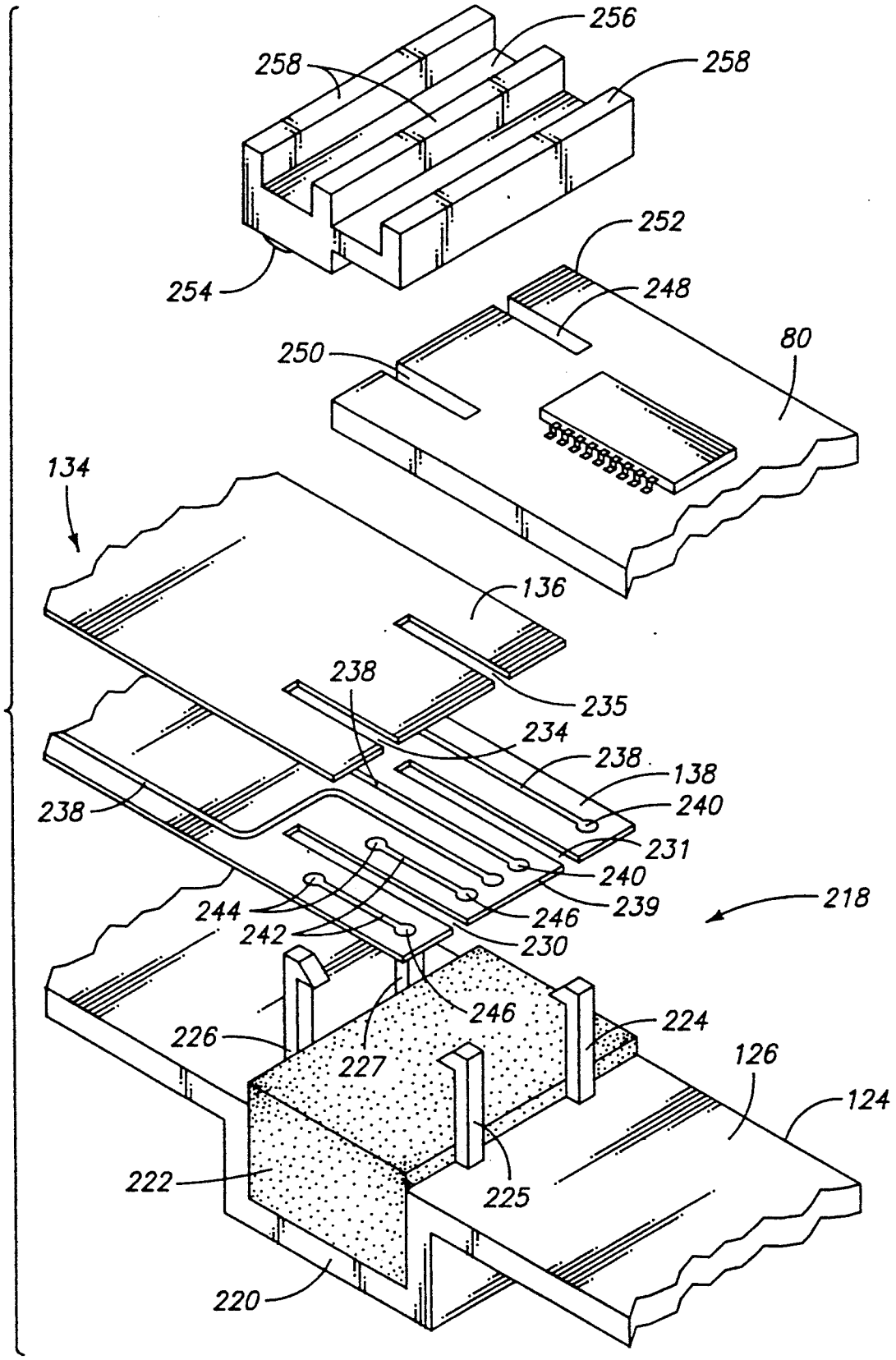
FIG. 16 is an diagrammatic, exploded, perspective view of the switch membrane/PCB interface of FIG. 15.

FIGS. 15 and 16 diagrammatically illustrate a switch membrane/PCB interface constructed according to this invention. Support plate 124 of bottom enclosure portion 122 has a rectangular shaped channel 220 formed therein. An interconnect block or support member 222, preferably formed of resilient material such as rubber or foam, is positioned within channel 220 and is slightly raised above upper surface 126 of support plate 124. Support plate 124 includes multiple deflectable fasteners 224–227 which project upward from upper surface 126 and are aligned along channel 220. The fasteners are described below in more detail.

Upper and lower layers 136 and 138 of switch membrane 134 are positioned on top of upper surface 126 and extend to the left (relative to the figure) of an interface region defined by support member 222. Lower layer 138 has slots 230 and 231 provided therein and upper layer 136 has slots 234 and 235 formed therein to receive respective fasteners 226 and 227. As an alternative to slots, openings sized to receive corresponding fasteners 226 and 227 may be provided in upper and lower layers 136 and 138.

Switch membrane 134 has multiple conductive traces (as represented by conductive traces 238 on lower layer 138) deposited and patterned thereon. These traces convey electric signals from the switch contacts positioned beneath the cantilevered keys to interface pads (as represented by pads 240 on lower layer 138) at peripheral end 239. Similar traces and interface pads are deposited and patterned on the bottom surface (not shown) of upper layer 136. Lower layer 138 also includes shunting traces 242 which have first ends 244 that electrically engage pads provided on upper layer 136 and second ends which define interface pads 246. The upper layer 136 pattern engagement to lower layer 138 pattern provides the circuit connection for the upper layer 136.

PCB 80 is positioned on top of upper surface 126 of support plate 124 and extends to the right (relative to the figure) of the interface region defined by support member 222. PCB 80 has slots 248 and 250 formed therein to receive corresponding fasteners 224 and 225. Peripheral end 252 of PCB 80 extends on top of peripheral end 239 such that conductive interface pads provided on PCB 80 (not shown) align with interface pads 240, 246 of switch membrane 134. PCB 80 is positioned adjacent to upper layer 136 of switch membrane 134, but does not overlap this layer. In alternative embodiments wherein a single layer switch membrane is employed, PCB 80 would simply overlap the single layer switch membrane.

Alternatively, the orientation of PCB to membrane can be such that the membrane upper layer lays on top of the PCB, using a portion of the dome sheet in place of support member 222. In this instance, the upper membrane layer would contain the shunting traces (242) and the upper layer extends slightly beyond lower layer.

Switch membrane/PCB interface 218 also includes an interconnect member 256 which is positioned above PCB 80 and switch membrane 134. Interconnect member 256 is stair-shaped to account for the relative heights of PCB 80 relative to switch membrane 134 which have been exaggerated in FIGS. 15 and 16 for illustration purpose. Member 256 has structural ribbing 258 which enhances longitudinal strength of the interconnect member. Fasteners 224–227 fit over the outside ribs 258 of the interconnect member 256.

When assembled, interconnect member 256 snaps into fasteners 224–227 to hold PCB 80 against switch membrane lower layer 138, and to hold upper layer 136 and lower layer 138 together. Fasteners 224–227 hold interconnect member 256 and PCB 80 to lower layer 138 against resilient support member 222 (which compresses slightly) to facilitate electric contact between the interface pads provided on PCB 80 and lower layer 138. The fasteners also hold upper layer 136 and lower layer 138 together to facilitate electrical connection between membrane layers. PCB 80 is thereby electrically coupled to receive electric signals from the switch contacts provided on upper and lower layers 136 and 138. Signals from lower layer 138 are interfaced to PCB 80 through pads 240. Signals from upper layer 136 are interfaced to PCB 80 through pads provided thereon and shunting traces 242 and pads 246 provided on lower layer 138. Support member 222, interconnect member 256, and fasteners 224 constitute interfacing means for connecting PCB 80 to switch membrane 134.

As an additional embodiment, interconnect member 256 has multiple force concentrator knobs 254 formed thereon which apply a concentrated pressure to selected locations on PCB 80 and switch membrane 134 within the interface region defined by support member 222.

The cantilevered keyboard according to this invention is advantageous over prior art keyboards because it eliminates the problems associated with the plastic-against-plastic bearing interface of conventional key structures with individual keys vertically moving within a key support. Another advantage of this invention is that entire rows of cantilevered keys are molded as an integral unit along mounting strips. During assembly, an entire row of keys may be placed on the keyboard by securing a single mounting strip to the support plate. This is more efficient than individually assembling 101 key bodies within their respect key supports.

This invention also has an advantage of providing a switch membrane/PCB interface which conserves packaging space. The new interface and the positioning of a small PCB board in the upper right hand corner of the keyboard beneath the indicator lights enables the construction of a relatively narrow keyboard.

In compliance with the statue, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A computer keyboard comprising:

a support plate;

a first mounting strip secured to the support plate, the first mounting strip having a front edge and a back edge;

a first row of first cantilevered keys, individual first cantilevered keys having at least one elongated member with one end flexibly attached to the first mounting strip adjacent the back edge and the other end coupled to a key cap, the first cantilevered keys extending from the back edge of the first mounting strip above and across the first mounting strip and beyond the front edge of the first mounting strip;

a second mounting strip secured to the support plate, the second mounting strip having a front edge and a back edge;

a second row of second cantilevered keys, individual second cantilevered keys having at least one elongated member with one end flexibly attached to the second mounting strip adjacent the back edge and the other end coupled to a key cap, the second cantilevered keys extending from the back edge of the second mounting strip above and across the second mounting strip and beyond the front edge of the second mounting strip to overlap a portion of the first cantilevered key; and upstop means for establishing an upward travel stop position of the second cantilevered keys, the upstop means comprising complementary first and second interlocking components, the first interlocking components being provided on the first mounting strip and the second interlocking components being provided on individual second cantilevered keys.

2. A computer keyboard according to claim 1 wherein:

the first mounting strip and the first cantilevered key are formed as a single, integral unit; and the second mounting strip and the second cantilevered key are formed as a single, integral unit.

3. A computer keyboard according to claim 1 wherein:

the elongated members of the first and second cantilevered keys are attached to respective first and second mounting strips by serpentine-shaped hinges.

4. A computer keyboard according to claim 1 wherein:

the elongated members of the first and second cantilevered keys are attached to respective first and second mounting strips by "S"-shaped hinges, individual "S"-shaped hinges having a first bend connected to the mounting strips and a second bend connected to the elongated member, the first bend having a cross-sectional thickness which is less than a cross-sectional thickness of the second bend.

5. A computer keyboard according to claim 1 wherein:

the first mounting strip has an aperture formed therein;

the first cantilevered key is movable from a rest position to a depressed activated position;

the second mounting strip has an aperture formed therein;

the second cantilevered key is movable from a rest position to a depressed activated position;

the computer keyboard further comprising:

a switch membrane positioned intermediate of the mounting strips and the support plate, the switch membrane having switch contacts aligned beneath corresponding apertures of the first and second mounting strips;

a dome sheet positioned intermediate of the mounting strips and the support plate, the dome sheet having resilient domes extending upward through corresponding apertures of the first and second mounting strips;

the elongated member of the first cantilevered key extending above the corresponding switch contact and the dome that extends through the aperture in the first mounting strip, the first cantilevered key actuating the corresponding switch contact when the first cantilevered key is depressed to its activated position; and the elongated member of the second cantilevered key extending above the corresponding switch contact and the dome that extends through the aperture in the second mounting strip, the second cantilevered key actuating the corresponding switch contact when the second cantilevered key is depressed to its activated position.

6. A computer keyboard comprising:

a support plate;

(a) a first unit comprising:

a first mounting strip secured to the support plate;

a first row of first cantilevered keys, individual first cantilevered keys having at least one elongated member with one end of a first width flexibly attached to the first mounting strip and the other end of a second width coupled to a key cap, the first width being greater than the second width, the individual first cantilevered keys being movable from a rest position to a depressed activated position;

(b) a second unit comprising:

a second mounting strip secured to the support plate;

a second row of second cantilevered keys adjacent to, and partially overlapping, the first row of first cantilevered keys, individual second cantilevered keys having at least one elongated member with one end of a first width flexibly attached to the second mounting strip and the other end of a second width coupled to a key cap, the first width being greater than the second width, the individual second cantilevered keys being movable from a rest position to a depressed activated position;

(c) a switch membrane positioned intermediate of the mounting strips and the support plate, the switch membrane having a row of switch contacts aligned beneath the first unit;

(d) a dome sheet positioned intermediate of the mounting strips and the support plate, the dome sheet having a row of resilient domes; and the second cantilevered keys extending above corresponding domes of the dome sheet and corresponding switch contacts beneath the first unit, the second cantilevered keys actuating the corresponding switch contacts when the second cantilevered keys are depressed to their activated positions.

7. A computer key according to claim 6 wherein:

the ratio of the first width to the second width is at least approximately 2:1.

8. A computer key according to claim 6 wherein:

the ratio of the first width to the second width is approximately 3:1.

9. A computer key according to claim 6 wherein:

the elongated member is attached to the mounting strip by a serpentine-shaped hinge;

the serpentine-shaped hinge has the first width; and a portion of the elongated member between the serpentine-shaped hinge and the key cap has the second width.

10. A computer key according to claim 6 wherein:

the elongated member is attached to the mounting strip by an "S"-shaped hinge, the "S"-shaped hinge having a first bend connected to the mounting strip and a second bend connected to the elongated member, the first bend having a cross-sectional thickness which is less than a cross-sectional thickness of the second bend;

the "S"-shaped hinge has the first width; and a portion of the elongated member between the "S"-shaped hinge and the key cap has the second width.

11. A computer keyboard comprising:

a support plate;

(a) a first unit comprising:

a first mounting strip secured to the support plate;

a first row of first cantilevered keys, individual first cantilevered keys having at least one elongated member with one end flexibly attached to the first mounting strip and the other end coupled to a key cap, the individual first cantilevered keys being movable from a rest position to a depressed activated position;

(b) a second unit comprising:

a second mounting strip secured to the support plate;

a second row of second cantilevered keys adjacent to, and partially overlapping, the first row of first cantilevered keys, individual second cantilevered keys having at least one elongated member with one end flexibly attached to the second mounting strip and the other end coupled to a key cap, the individual second cantilevered keys being movable from a rest position to a depressed activated position;

(c) a switch membrane positioned intermediate of the mounting strips and the support plate, the switch membrane having a row of switch contacts aligned beneath the first unit;

(d) a dome sheet positioned intermediate of the mounting strips and the support plate, the dome sheet having a row of resilient domes; and the second cantilevered keys extending above corresponding domes of the dome sheet and corresponding switch contacts beneath the first unit, the key caps of the second cantilevered keys having actuating means for engaging the corresponding domes and actuating the switch contacts beneath the first unit when the second cantilevered keys are depressed to their activated positions.

12. A computer key according to claim 11 wherein:

individual key caps of the second cantilevered keys have a top surface contoured for receiving an operator's finger and a bottom surface facing the switch contact and resilient dome; and the actuating means comprises a member projecting downward from the bottom surface to engage the dome.

13. A computer key according to claim 11 wherein:

individual key caps of the second cantilevered keys have a top surface contoured for receiving an operator's finger and a bottom surface facing the switch contact and resilient dome; and the actuating means comprises a "T"-shaped member projecting downward from the bottom surface to engage the dome.

* * * * *